US011295675B2

(12) United States Patent
Seo

(10) Patent No.: US 11,295,675 B2
(45) Date of Patent: Apr. 5, 2022

(54) DISPLAY DEVICE AND METHOD OF COMPENSATING PIXEL DETERIORATION THEREOF

(71) Applicant: LG Display Co., Ltd., Seoul (KR)

(72) Inventor: Woong Jin Seo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/233,350

(22) Filed: Apr. 16, 2021

(65) Prior Publication Data

US 2021/0343241 A1 Nov. 4, 2021

(30) Foreign Application Priority Data

Apr. 29, 2020 (KR) ..... 10-2020-0052821

(51) Int. Cl.

| | |
|---|---|
| ***G09G 3/3266*** | (2016.01) |
| ***G09G 3/00*** | (2006.01) |
| ***G09G 3/3258*** | (2016.01) |
| ***G09G 3/3291*** | (2016.01) |

(52) U.S. Cl.

CPC ..... *G09G 3/3258* (2013.01); *G09G 3/006* (2013.01); *G09G 3/3266* (2013.01); *G09G 3/3291* (2013.01); *G09G 2320/0626* (2013.01); *G09G 2360/144* (2013.01); *G09G 2380/10* (2013.01)

(58) Field of Classification Search

CPC .... G09G 3/3258; G09G 3/006; G09G 3/3266; G09G 3/3291; G09G 3/3225; G09G 2360/144; G09G 2360/16; G09G 2320/0626

See application file for complete search history.

(56) References Cited

U.S. PATENT DOCUMENTS

| | | | | |
|---|---|---|---|---|
| 9,472,163 | B2 * | 10/2016 | Gould | G09G 5/10 |
| 10,453,388 | B2 * | 10/2019 | Lee | G09G 3/32 |
| 2013/0222354 | A1 * | 8/2013 | Koivunen | G09G 3/3611 345/207 |
| 2018/0151117 | A1 * | 5/2018 | Choi | G09G 3/3225 |
| 2018/0330697 | A1 * | 11/2018 | Lee | G09G 5/363 |

FOREIGN PATENT DOCUMENTS

| | | | |
|---|---|---|---|
| KR | 10-2016-0002244 | A | 1/2016 |
| KR | 10-2016-0139677 | A | 12/2016 |
| KR | 10-2019-0076154 | A | 7/2019 |
| KR | 10-2020-0041027 | A | 4/2020 |

* cited by examiner

*Primary Examiner* — Sardis F Azongha
(74) *Attorney, Agent, or Firm* — Polsinelli PC

(57) ABSTRACT

The present disclosure relates to a display device and a method of compensating pixel deterioration thereof, capable of determining deterioration of pixels and sensing illuminance of a surrounding environment. The pixel deterioration compensation method compensates for deterioration of the pixels with a target compensation level varied according to illuminance. Accordingly, image quality and lifespan of the pixels is improved by mitigating or preventing acceleration of deterioration of the pixels without deteriorating image quality such as afterimages.

16 Claims, 13 Drawing Sheets

| ILLUMINANCE | α |
|---|---|
| 0~10lx | 1 |
| 10~250lx | 0.8 |
| 250~5000lx | 0.6 |
| 5000lx | 0.4 |

DISPLAY DEVICE AND METHOD OF COMPENSATING PIXEL DETERIORATION THEREOF

CROSS-REFERENCE TO RELATED APPLICATION

This application claims priority to and the benefit of Korean Patent Application No. 10-2020-0052821, filed on Apr. 29, 2020, which is hereby incorporated by reference in its entirety.

BACKGROUND

Field of the Disclosure

The present disclosure relates to a display device that varies a target compensation level of pixels according to illuminance of a surrounding environment, and a method for compensating pixel deterioration thereof.

Description of the Background

An electroluminescent display device is roughly classified into an inorganic light emitting display device and an organic light emitting display device depending on the material of a light emitting layer. The organic light emitting display device of an active matrix type includes an Organic Light Emitting Diode (hereinafter referred to as "OLED") that emits light by itself. Accordingly, there are advantages that the response speed is fast, and the luminous efficiency, luminance and viewing angle are large. Further, in the organic light emitting display device, the light emitting diode is formed on each of the pixels. Thus, the organic light emitting display device has a high response speed, excellent luminous efficiency, luminance, viewing angle, and the like, and is capable of expressing black gradation in complete black, thereby providing excellent contrast ratio and color reproduction.

The pixels in the organic light emitting display device include an OLED, a driving element that supplies a current flowing through the OLED according to the gate-source voltage Vgs, and a storage capacitor that maintains a gate voltage of the driving element.

The driving element may be implemented as a transistor. In order to make the image quality of the entire screen of the organic light emitting display device uniform, the driving element has uniform electrical characteristics among all pixels. However, there may be a difference in the electrical characteristics between the pixels due to process deviations and device characteristic deviations caused in the manufacturing process of the display panel. This difference may become larger as the driving time of the pixels elapses. The driving elements for the pixels are deteriorated because they are subjected to more stress as the driving time of the pixels increases and the voltage applied to the gate is increased or the DC voltage is applied for a long time. Due to the difference in the degree of deterioration of each of the pixels, an afterimage may be seen on the screen. A compensation technique may be applied to compensate for the difference in the level of deterioration between pixels.

SUMMARY

In order to compensate for deterioration of the pixels, pixel data that is written to the pixels may be modulated. In this case, the data voltage applied to the gate of the driving element may increase. As the driving time of the pixels elapses, the deterioration of the pixels proceeds, the compensation level therefor becomes higher as the time elapses, thereby accelerating the deterioration of the pixels and reducing the lifetime of the pixels.

Therefore, the present disclosure provides a display device that allows pixels to extend their lifetime without deteriorating image quality and a method of compensating pixel deterioration.

The present disclosure is not limited to the above-described features, and other features that are not described herein will be apparently understood by those skilled in the art from the following description.

According to an aspect of the present disclosure, there is provided a display device including a display panel in which a plurality of scan lines are intersected with a plurality of data lines and a plurality of pixels are arranged, a deterioration determination unit configured to determine deterioration of the pixels, a sensing unit configured to sense the illuminance of a surrounding environment of the display panel, and a compensation block configured to receive a deterioration sensing value or a deterioration predicted value from the deterioration determination unit and receive illuminance data from the sensing unit to compensate for the deterioration of the pixels with a target compensation level varied according to the illuminance.

According to another aspect of the present disclosure, there is provided a method for compensating pixel deterioration of the display device, comprising determining deterioration of the pixels, sensing the illuminance of the surrounding environment of the display panel, and compensating for the deterioration of the pixels with a target compensation level varied according to the illuminance.

According to the present disclosure, a target compensation level of pixels in a high-illuminance environment may be lowered compared to a low-illuminance environment by using a phenomenon in which an afterimage is not recognized in a high-illuminance environment. As a result, according to the present disclosure, the image quality and lifetime of pixels may be improved by mitigating or preventing acceleration of deterioration of pixels without deteriorating image quality such as afterimages.

In addition, according to the present disclosure, the target compensation level of pixels may be varied according to the illuminance in a use environment, by determining illuminance using an external illuminance sensor connected to the display device or photo sensors mounted on a display panel.

Effects which can be achieved by the present disclosure are not limited to the above-mentioned effects. That is, other features that are not mentioned may be obviously understood by those skilled in the art to which the present disclosure pertains from the following description.

BRIEF DESCRIPTION OF THE DRAWINGS

The above features and advantages of the present disclosure will become more apparent to those of ordinary skill in the art by describing exemplary aspects thereof in detail with reference to the attached drawings, in which.

DETAILED DESCRIPTION

Figure 1:
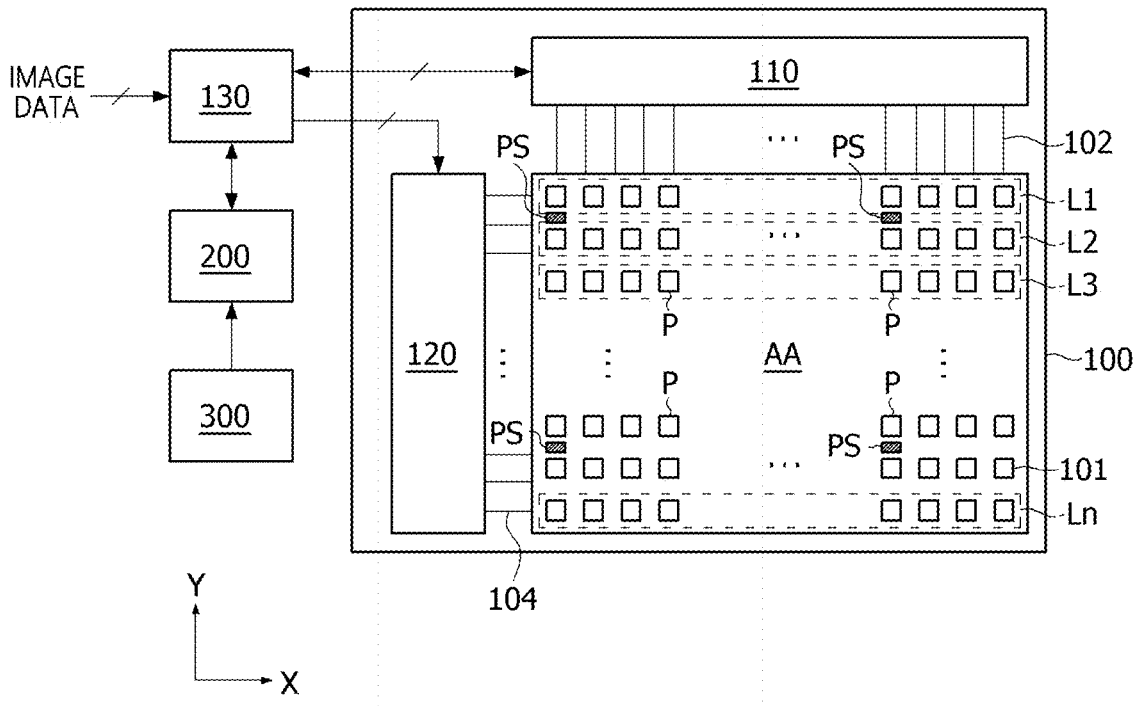
FIG. 1 is a block diagram showing a display device according to an exemplary aspect of the present disclosure.

Advantages and features of the present disclosure, and implementation methods thereof will be clarified through the following aspects described with reference to the accompanying drawings. However, the present disclosure is not limited to aspects disclosed herein and may be implemented in various different forms. The aspects are provided for making the disclosure of the prevention disclosure thorough and for fully conveying the scope of the present disclosure to those skilled in the art. It is to be noted that the scope of the present disclosure is defined by the claims.

The figures, dimensions, ratios, angles, numbers, and the like disclosed in the drawings for describing the aspects of the present disclosure are merely illustrative and are not limited to matters shown in the present disclosure. Like reference numerals refer to like elements throughout. Further, in describing the present disclosure, detailed descriptions of well-known technologies will be omitted when it is determined that they may unnecessarily obscure the gist of the present disclosure.

Terms such as "including" and "having" used herein are intended to allow other elements to be added unless the terms are used with the term "only." Any references to singular may include plural unless expressly stated otherwise.

Components are interpreted to include an ordinary error range even if not expressly stated.

For description of a positional relationship, for example, when the positional relationship between two parts is described as "on," "above," "below," "next to," and the like, one or more parts may be interposed therebetween unless the term "immediately" or "directly" is used in the expression.

While terms, such as "first", "second", etc., may be used to describe various components, such components must not be limited by the above terms. The above terms are used only to distinguish one component from another.

For description of a temporal relationship, for example, when a temporal relationship is described as "after," "subsequently to," "next," "before," and the like, a non-consecutive case may be included unless the term "immediately" or "directly" is used in the expression.

The features of various aspects of the present disclosure may be partially or entirely bonded to or combined with each other. The aspects may be interoperated and performed in technically various ways and may be carried out independently of or in association with each other.

Hereinafter, various aspects of the present disclosure will be described in detail with reference to the accompanying drawings. In the following aspects, an organic light emitting display device will be described as an example, but the present disclosure is not limited thereto.

The display device of the present disclosure may include a deterioration determination unit for determining deterioration of pixels, a sensing unit for sensing the illuminance of the surrounding environment of the display panel, and a compensation block for receiving a deterioration sensing value or a deterioration predicted value from the deterioration determination unit and receiving illuminance data from the sensing unit to compensate for the deterioration of the pixels with a target compensation level that is varied according to the illuminance. The deterioration determination unit may include one or more of the sensing unit 111 and the prediction unit 210 in the aspect. The sensing unit may include one or more of an external illuminance sensor 300 connected to the display device or a photo sensor PS embedded on the display panel 100.

FIG. 1 is a block diagram showing a display device according to an exemplary aspect of the present disclosure.

Referring to FIG. 1, a display device according to an aspect of the present disclosure includes a display panel 100, a display panel driving unit 110 and 120 for writing data of an input image to pixels of the display panel 100, a timing controller 130 for controlling the display panel driving unit 100 and 120, and a compensation block 200 for compensating for deterioration of each of the pixels by modulating pixel data of the input image.

The screen of the display panel 100 includes a pixel array AA that displays the input image. The pixel array AA includes a plurality of data lines 102, a plurality of scan lines 104 intersected with the data lines 102, and pixels P arranged in a matrix form.

When the resolution of the pixel array AA is m*n, the pixel array AA has m number of pixel columns (m is a positive integer greater than or equal to 2), and n number of pixel lines L1 to Ln intersected with the pixel column (n is a positive integer greater than or equal to 2). The pixel column includes pixels arranged along the y-axis direction. The pixel line includes pixels P arranged along the x-axis direction. One vertical period is one frame period required to write pixel data for one frame to all pixels P in the screen. This is the time required to write pixel data for one line sharing a gate line to the pixels in one-pixel line. One horizontal period is a time obtained by dividing one frame period by the number of m pixel lines L1 to Lm, that is, the vertical resolution of the display panel 100.

Each of the pixels P may be divided into a red sub-pixel, a green sub-pixel, and a blue sub-pixel for color implementation. Each of the pixels P may further include sub-pixels of different colors including white color. Each of the sub-pixels may include a pixel circuit having substantially the same structure. Hereinafter, the pixel may be interpreted as a sub-pixel.

Touch sensors may be disposed on the display panel 100. A touch input may be sensed using separate touch sensors or may be sensed through pixels. The touch sensors may be disposed on the screen of the display panel in On-cell type or Add-on type in-cell type, or may be implemented as In-cell type touch sensors embedded in the pixel array.

The display panel driving units 110 and 120 include a data driving unit 110 and a gate driving unit 120. The display panel driving unit may further include a touch sensor driving unit for driving the touch sensors. The touch sensor driving unit is omitted in FIG. 1.

A demultiplexer (not shown) may be disposed between the data driving unit 110 and the data lines 102. The demultiplexer is disposed between the data driving unit 110 and the data lines 102 to distribute a data voltage output from the data driving unit 110 to the data lines 102. Since one channel of the data driving unit 110 is connected to a plurality of data lines by the demultiplexer, the number of data lines 102 may be reduced.

The display panel driving units 110 and 120 write pixel data of an input image received from the timing controller 130 to pixels under the control of the timing controller 130 to display the input image on the screen.

In a mobile device or a wearable device, the data driving unit 110, the timing controller 130, and a power supply unit (not shown) may be integrated into one integrated circuit. The power supply unit generates power required for driving the display panel driving units 110 and 120, the timing controller 130, and the pixels.

The data driving unit 110 receives digital data (pixel data) received through the timing controller 130. The data driving unit 110 converts pixel data of an input image into a gamma compensation voltage using a digital to analog converter (hereinafter referred to as "DAC") and outputs a data voltage. The pixel data of the input image may be compensation data modulated with a compensation value selected by the compensation block 200 to compensate for deterioration of the pixel. The data voltage is supplied to the pixels through the data line 102.

The gate driving unit 120 may shift the gate signal using a shift register to sequentially supply the gate signal to the respective scan lines 104. The gate signal may include a scan signal synchronized with the data voltage. In addition, the gate signal may include a sense signal SENSE generated in a sensing mode. The sense signal SENSE may be replaced with a scan signal SCAN. The gate driving unit 120 may be implemented as a Gate in panel (GIP) circuit formed directly on a bezel region on the display panel 100 together with a transistor array in an active region.

The timing controller 130 receives pixel data of an input image received from a host system (not shown) and a timing signal synchronized with the pixel data. The timing controller 130 controls operation timings of the data driving unit 110, the gate driving unit 120, and the compensation block 200 based on a timing signal received from the host system.

The host system may be any one of a Television (TV) system, a set-top box, a navigation system, a personal computer (PC), a home theater system, a vehicle system, a mobile device, and a wearable device.

The compensation block 200 may modulate pixel data by adding or multiplying a compensation value to pixel data of an input image in order to compensate for deterioration of pixels. The pixel data modulated by the compensation block 200 is transmitted to the data driving unit 110 through the timing controller 130.

The compensation block 200 may select a compensation value according to a deterioration sensing value of pixels obtained through sensing lines connected to the pixels. In another aspect, the compensation block 200 may predict a deterioration amount for each sub-pixel based on a result of accumulating pixel data of an input image for each sub-pixel. The compensation block 200 may select a compensation value according to a predicted value of a deterioration amount of pixels.

The compensation block 200 may adjust the compensation level according to the output value of the illuminance sensor 300. The higher the surrounding brightness of the display panel 100, the lower the visibility for the afterimage. When the illuminance of the environment in which the display device is used is high, since the reflected luminance of external light incident on the screen is high, the user cannot see the afterimage of the screen. Conversely, if the illuminance of the environment in which the display panel 100 is used is low, since there is little external light incident on the screen, an afterimage of the screen may be visually recognized. The compensation block 200 varies the target compensation level of pixels according to the surrounding illuminance of the display panel 100.

The compensation block 200 lowers the target compensation level when the surrounding illuminance of the display panel 100 is high. The target compensation level is the amount of compensation necessary to increase the luminance decrease due to the deterioration of the pixel to the target luminance. When the target compensation level is adjusted to be low, the pixel data is modulated with a compensation value of a compensation level lower than the target compensation level set as a low-illuminance reference regardless of illuminance. Accordingly, according to the present disclosure, when the surrounding illuminance of the display panel 100 is high, the target compensation level is lowered, and thus acceleration of deterioration of pixels may be mitigated without deteriorating image quality felt by the user, thereby extending the lifetime of the pixels.

The compensation block 200 may be embedded in an IC chip (CHIP) of the timing controller 130. The illuminance sensor 300 may be an illuminance sensor connected to a host system or an illuminance sensor connected to a display device. In the case of the vehicle system, the illuminance sensor 300 may be an illuminance sensor connected to an electronic control unit (ECU). In the case of the vehicle system, the compensation block 200 may receive illuminance data obtained from an illuminance sensor installed in the vehicle through the ECU or lighting data of an indoor light, instead of the illuminance data from the illuminance sensor 300. When the indoor light is turned on in the vehicle, the surrounding illuminance of the display panel increases. The compensation block 200 may vary the target compensation level by calculating illuminance by reflecting indoor light data of the vehicle.

The display device may further include a photo sensor PS embedded in the display panel. One or more photo sensors PS embedded in the display panel 100 may be disposed at the top and/or the bottom of the display panel 100 outside the pixel array AA, or may be distributed and disposed at multiple points in the pixel array AA as shown in FIG. 1. The data obtained from photo sensors PS may be transmitted to the compensation block 200 instead of the illuminance data output from the illuminance sensor 300. The photo sensors PS may be distributed and disposed on the display panel 100. In this case, the compensation block 200 may analyze the sensor data collected from the photo sensors embedded in the display panel 100, determines the illuminance for each position of the display panel 100. Further, the compensation block 200 may determine a local area with high illuminance, and the compensation level may be lowered only for pixels in this area. Meanwhile, a detailed description of an example in which photo sensors are embedded in the display panel will be omitted. For example, in Korean Patent Laid-Open Application Publication No. 10-2020-0041027 (Apr. 21, 2020), Korean Patent Laid-Open Application Publication No. 10-2019-0076154 (Jul. 2, 2019), etc., previously filed by the applicant of the present application, there are disclosed examples in which photo sensors are embedded on the display panel.

The compensation block 200 may analyze output data from the illuminance sensor 300 outside the display panel 100 or photo sensors PS embedded in the display panel 100 to adaptively vary the target compensation level of pixels. For example, the compensation block 200 may set a weight given to the output data of the illuminance sensor 300 to be higher than a weight given to the output data of the photo sensors PS, so that the target compensation level may be varied by relying more on sunlight than indoor light in the vehicle system.

The display device of the present disclosure may include an internal compensation circuit and/or an external compensation circuit in order to reduce deterioration of pixels and extend a lifetime. The internal compensation circuit may be disposed in each of the pixel circuits of the sub-pixels, such that the gate-source voltage Vgs of the driving element DT, which changes according to the electrical characteristics of the driving element, may be sampled, and the gate voltage of the driving element may be compensated by the gate-source voltage Vgs. The external compensation circuit may sense the electrical characteristics of the driving element DT and the light emitting element EL in real time and reflect the sensing result to modulate the pixel data of the input image, such that changes in electrical characteristics of each of the sub-pixels or deviations in electrical characteristics between sub-pixels may be compensated in real time.

Figure 2:
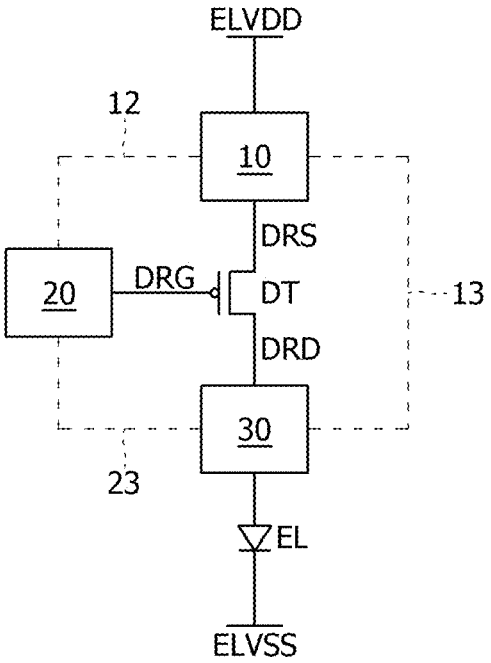
FIG. 2 is a diagram schematically showing a pixel circuit of the present disclosure.

FIG. 2 is a diagram schematically showing a pixel circuit.

Referring to FIG. 2, the pixel circuit may include first to third circuit units 10, 20, and 30 and first to third connection units 12, 23, and 13. One or more components may be omitted or added in the pixel circuit.

The first circuit unit 10 supplies a pixel driving voltage ELVDD to a driving element DT. The driving element DT may be implemented as a transistor including a gate DRG, a source DRS, and a drain DRD. The second circuit unit 20 may charge a capacitor Cst connected to the gate DRG of the driving element DT and maintain the voltage of the capacitor Cst for one frame period. The third circuit unit 30 converts the current into light by providing the current supplied from the pixel driving voltage ELVDD to a light emitting element EL through the driving element DT.

The third circuit unit 30 may be connected to a sensing unit that senses a change in an electrical characteristic or a threshold voltage of the driving element DT in real time.

The first connection unit 12 connects the first circuit unit 10 and the second circuit unit 20. The second connection unit 23 connects the second circuit unit 20 and the third circuit unit 30. The third connection unit 13 connects the third circuit unit 30 and the first circuit unit 10. Each of the first connection unit 12, the second connection unit 23, and the third connection unit 13 may include one or more transistors and wires.

Figure 5:
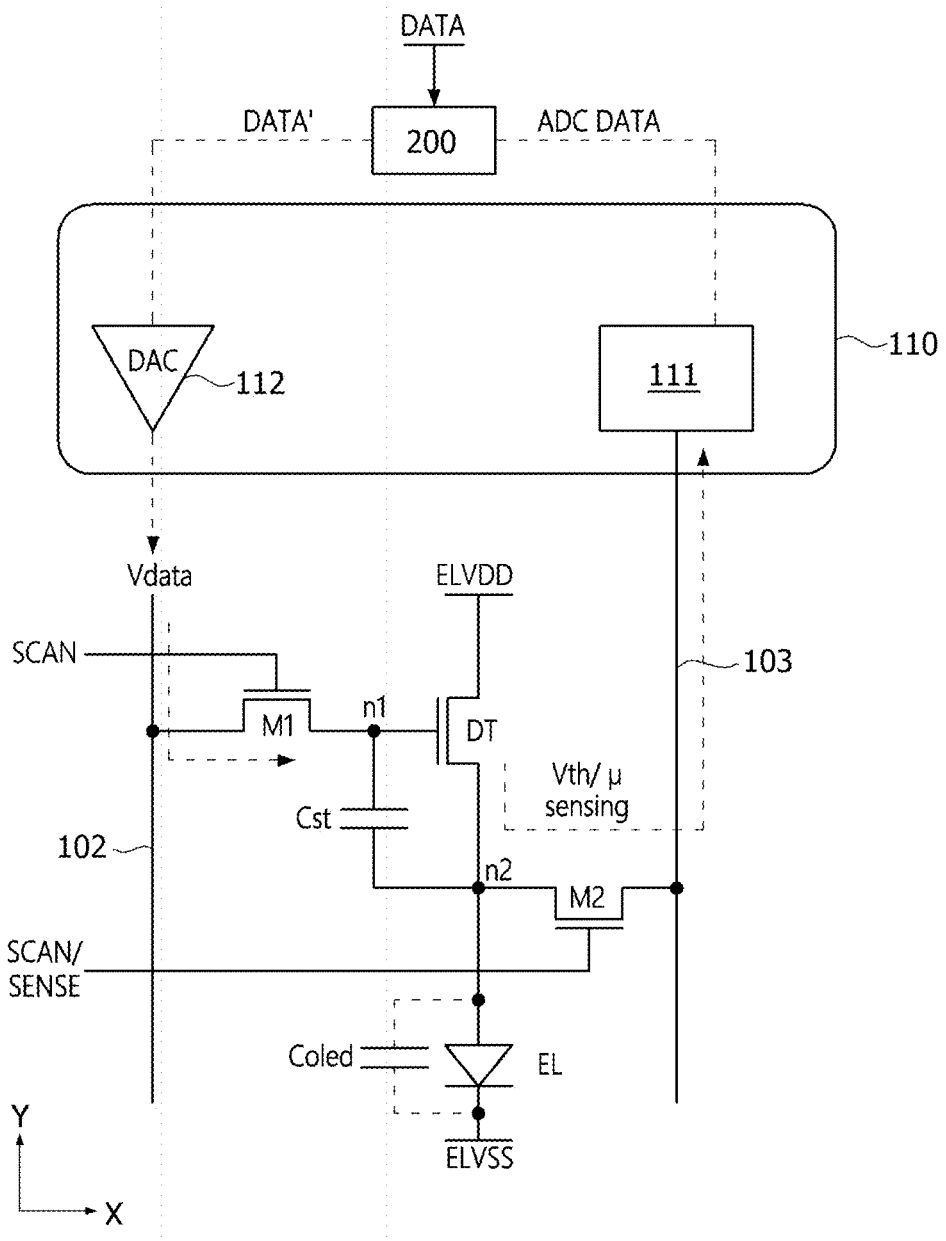
FIG. 5 is a circuit diagram showing an external compensation circuit connected to a pixel circuit.

The internal compensation circuit may be implemented with one or more switch elements disposed in the circuit units 10, 20, and 30. It should be noted that the internal compensation circuit is not limited to a specific circuit since it may be implemented with any known circuit. The driving element DT and the switch elements may be implemented with an oxide Thin Film Transistor (TFT) including an oxide semiconductor, an LTPS TFT including Low Temperature Poly Silicon (LTPS), or the like. Each of the transistors may be implemented as a p-channel metal-oxide-semiconductor field effect transistor (MOSFET) or transistors of an n-channel MOSFET structure. For example, the driving element DT may be implemented as a p-channel transistor as shown in FIG. 2 or as an n-channel transistor as shown in FIG. 5.

Figure 3:
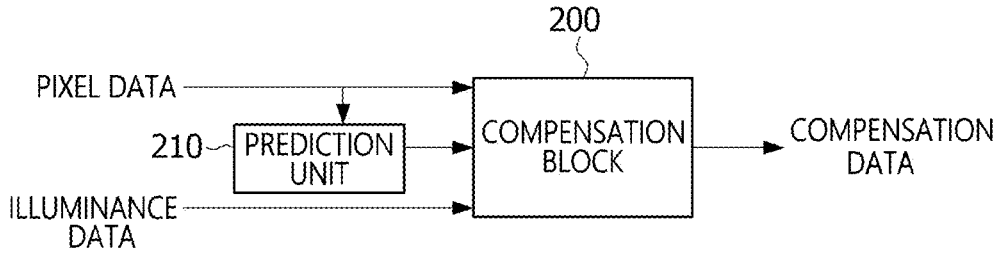
FIG. 3 is a diagram illustrating an example in which a prediction unit is connected to a compensation block.

FIG. 3 is a diagram illustrating an example in which a prediction unit 210 is connected to a compensation block 200.

Referring to FIG. 3, the prediction unit 210 predicts deterioration of each sub-pixel by receiving pixel data of an input image and summing the pixel data for each sub-pixel. As the sum of the pixel data accumulated in the sub-pixel increases, the amount of deterioration of the sub-pixel increases.

The compensation block 200 selects a compensation value for each sub-pixel based on the predicted data of the deterioration amount input from the prediction unit 210 and varies the compensation value according to the illuminance data. The illuminance data may be output data of the illuminance sensor 300 or a photo sensor PS embedded in the display panel 100. The compensation block 200 may receive the illuminance data and determine the surrounding illuminance of the display panel 100. When the display device is used in a high-illuminance environment, the compensation block 200 lowers the target compensation level, selects a compensation value lower than the compensation value of the target compensation level preset in the low-illuminance environment, and modulates pixel data by adding or multiplying the selected compensation value to pixel data to output compensation data. The compensation data output from the compensation block 200 is transmitted to the data driving unit 110 and converted into a data voltage.

In the display device of the present disclosure, when pixel data of the same gray scale is written to a pixel, the target luminance of a pixel may be set lower in a high-illuminance environment than in a low-illuminance environment. Accordingly, a target compensation level of a pixel for reaching target luminance in the high-illuminance environment may be lower than a target compensation level of a pixel for reaching target luminance in the low-illuminance environment.

Figure 4:
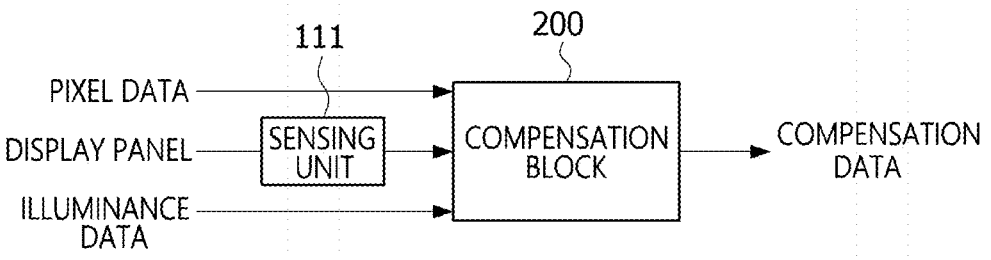
FIG. 4 is a diagram showing an example in which a sensing unit is connected to a compensation block.

FIG. 4 is a diagram showing an example in which a sensing unit 111 is connected to a compensation block 200. This aspect includes a sensing unit 111 of an external compensation circuit that senses electrical characteristics of sub-pixels in real time.

Referring to FIG. 4, the sensing unit 111 senses electrical characteristics of each of the sub-pixels. As an example of the electrical characteristic, it may be a threshold voltage and/or mobility of the driving element DT.

The compensation block 200 may select a compensation value according to a deterioration sensing value of electrical characteristics for each sub-pixel input through the sensing unit 111. The compensation block 200 lowers the target compensation level in a high-illuminance environment and selects a compensation value lower than a preset compensation value in a low-illuminance environment, such that the pixel data may be modulated by adding or multiplying the lowered compensation value to the pixel data to output compensation data. The compensation data output from the compensation block 200 is transmitted to the data driving unit 110 and converted into a data voltage.

As the surrounding illuminance of the display panel 100 increases, the lower target compensation level may decrease. For example, as the surrounding illuminance value of the display panel 100 increases, the compensation block 200 may further reduce the target compensation level to further mitigate acceleration of deterioration of a sub-pixel due to deterioration compensation.

The external compensation circuit includes a sensing line 103 and a sensing unit 111 connected to the pixel circuit in each of the sub-pixels, as shown in FIG. 5. The sensing line 103 may be disposed on the screen of the display panel 100 in parallel with the data lines 102. The sensing unit 111 senses electrical characteristics of each of the sub-pixels through the sensing line 103.

Referring to FIG. 5, a pixel circuit connected to an external compensation circuit may include a light emitting element EL, a driving element DT connected to the light emitting element EL, a plurality of switch elements M1 and M2, and a capacitor Cst. The driving element DT and the switch elements M1 and M2 may be implemented as n-channel transistors, but are not limited thereto.

The light emitting element EL emits light with a current generated according to the gate-source voltage Vgs of the driving element DT that changes according to the data voltage Vdata. The light emitting element EL may be implemented as an OLED including an organic compound layer formed between an anode and a cathode. The organic compound layer may include, but is not limited to, a hole injection layer (HIL), a hole transport layer (HTL), an emission layer (EML), an electron transport layer (ETL), an electron injection layer (EIL), and the like. The anode of the light emitting element EL is connected to the driving element DT through a second node n2, and the cathode of the light emitting element EL is connected to a ELVSS node to which a low potential power voltage ELVSS is applied. In FIG. 5, "Coled" is a capacitance of the light emitting element EL.

The first switch element M1 is turned on according to a gate-on-voltage of the scan signal SCAN, such that the data line 102 is connected to a first node n1 to supply the data voltage Vdata to the first node n1. The first switch element M1 includes a gate electrode to which the scan signal SCAN is applied, a first electrode connected to the data line 102, and a second electrode connected to the first node n1. The first node n1 is connected to the gate electrode of the driving element DT, the first electrode of the capacitor Cst, and the second electrode of the first switch element M1.

The second switch element M2 is turned on according to the gate-on voltage of the scan signal SCAN or the sensing signal SENSE to supply a predetermined reference voltage to the second node n2. The second switch element M2 includes a gate electrode to which the scan signal SCAN or the sensing signal SENSE is applied, a first electrode connected to the second node n2, and a sensing line 103 to which a reference voltage is applied. The second node n2 is connected to the second electrode of the driving element DT, the second electrode of the capacitor Cst, and the first electrode of the second switch element M2.

The driving element DT drives the light emitting element EL by supplying current to the light emitting element EL according to the gate-source voltage Vgs. The driving element DT includes a gate connected to the first node n1, a first electrode to which the pixel driving voltage ELVDD is supplied and a second electrode connected to the second node n2.

The capacitor Cst is connected between the first node n1 and the second node n2 to maintain the gate-source voltage Vgs of the driving element DT for one frame.

The sensing unit 111 may be integrated in an integrated circuit (IC) of the data driving unit 110 together with the DAC 112.

The external compensation circuit may initialize the source voltage of the sensing line 103 and the driving element DT, which is the voltage of the second node n2, as a reference voltage, and then sense the voltage of the second node n2 to sense electrical characteristics of the light emitting element EL and the driving element DT. The electrical characteristics of the light emitting element EL and the driving element DT may include a threshold voltage Vth and a mobility μ.

The sensing unit 111 may include an integrator and an analog-to-digital converter (hereinafter referred to as "ADC"). The sensing unit 111 inputs the current or voltage on the sensing line 103 connected to the pixel circuit to the integrator and samples it in the sensing mode. The output voltage of the integrator is input to the ADC and converted into digital data ADC DATA. The digital data ADC DATA output from the ADC 115 includes sensing values indicating electrical characteristics of each of the sub-pixels.

The compensation block 200 includes a look-up table in which compensation values for compensating for the threshold voltage Vth and the mobility μ of the driving element DT are set for each sub-pixel. The compensation block 200 modulates pixel data by inputting sensing data received through the ADC into a lookup table and adding a compensation value output from the lookup table to the pixel data DATA of the input image.

When the surrounding illuminance of the display panel 100 is high according to the illuminance data, the compensation block 200 lowers the target compensation level and modulates the pixel data to a compensation value lower than the compensation value indicated by the sensing data to output compensation data. The compensation data DATA' output from the compensation block 200 is transmitted to the data driving unit 110. The data driving unit 110 converts the compensation data DATA' input from the compensation block 200 into a data voltage Vdata through the DAC 112 to output it to the data line 102.

Figure 6:
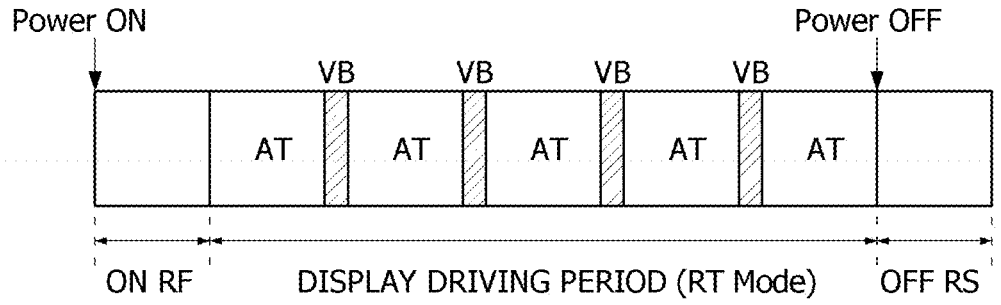
FIG. 6 is a diagram showing sensing timing of an external compensation circuit.
Figure 7:
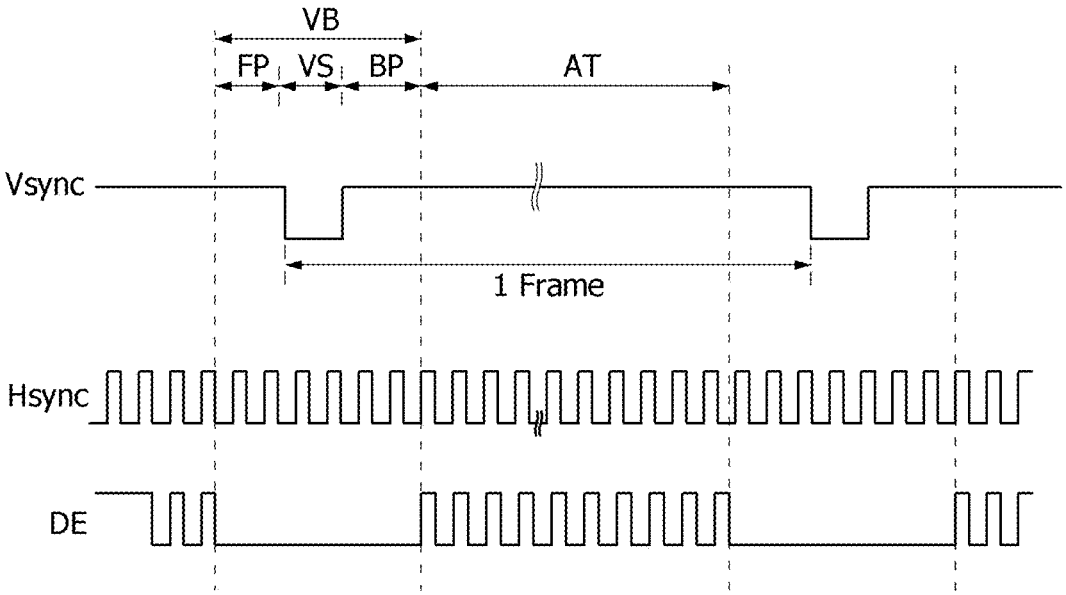
FIG. 7 is a waveform diagram showing in detail an active interval and a vertical blank interval shown in FIG. 6.

FIG. 6 is a diagram showing sensing timing of an external compensation circuit. FIG. 7 is a waveform diagram showing in detail an active interval and a vertical blank interval shown in FIG. 6.

Referring to FIGS. 6 and 7, the sensing mode is divided into before product shipment and after product shipment. Before product shipment, the electrical characteristics Vth and μ of the driving element DT are sensed in each of the sub-pixels through an external compensation circuit connected to the pixels. Based on this sensing value, changes or deviations in the electrical characteristics Vth and μ of the driving element DT are compensated for each sub-pixel. The compensation values reflecting the result of sensing the threshold voltage and mobility of the driving element DT for each sub-pixel are set in the lookup table before product shipment and stored in a memory connected to the timing controller 130.

After product shipment, the sensing mode may be divided into an ON RF mode performed in a Power-On sequence, a RT mode performed in the vertical blank interval VB during the display driving period, and an OFF RS mode performed in a power OFF sequence In the ON RF mode, when the power of the display device is turned on, the mobility μ of the driving element DT is sensed in each of the sub-pixels, and the mobility sensing value is compared with the mobility compensation value of the previous driving element DT. Based on the difference, the mobility compensation value is updated. The mobility μ of the driving element DT is compensated by the mobility compensation value reflecting the mobility sensing value for each sub-pixel.

In the RT mode, the mobility μ of the driving element DT is sensed in real time in the vertical blank interval VB in every frame period during the display driving period in which the image is displayed, and the mobility compensation value is updated for each sub-pixel according to the mobility sensing value. The vertical blank interval VB is allocated for a predetermined time between the active interval AT of the N−1th frame period and the active interval AT of the Nth frame period (N is a natural number).

In the OFF RS mode, when the display device is turned off, the threshold voltage Vth of the driving element DT in each of the pixels is sensed and a threshold voltage compensation value is updated for each sub-pixel according to the threshold voltage sensing value. In the OFF RS mode, the display panel driving unit and the external compensation circuit are driven for a preset delay time before the power is completely turned off. In this case, the threshold voltage Vth of the driving element DT in each of the sub-pixels is sensed, and the threshold voltage compensation value is updated for each sub-pixel. When the threshold voltage compensation value is updated at the Nth power OFF time point OFF(N), it may be updated at the N+1th power OFF time point OFF(N) after being maintained in the ON RF mode and RT mode.

In FIG. 7, a vertical synchronization signal Vsync defines one frame period. One frame period is the sum of the active interval AT and the vertical blank interval VB. A horizontal synchronization signal Hsync defines one horizontal period (time). A data enable signal DE is synchronized with pixel data to be displayed on one-pixel line in the input image to define an effective data interval.

One pulse cycle of the data enable signal DE and the horizontal synchronization signal Hsync is 1 horizontal period (1H), and a high logic interval of the data enable signal DE is the data input timing of 1-pixel line. Represents. One horizontal period (1H) is a time required to write pixel data to pixels of one-pixel line in the display panel 100.

The timing controller 130 receives pixel data of an input image synchronized with the data enable signal DE during the active interval AT, and transmits the pixel data to the data driving unit 110. During the vertical blank interval VB, there is no data enable signal DE received by the timing controller 130 and no pixel data of an input image, and no pixel data is transmitted to the data driving unit 110. The timing controller 130 receives data for one frame to be written to all the pixels P during the active interval AT.

As may be seen from the data enable signal DE, input data is not received by the display device during the vertical blank interval VB. The vertical blank interval VB includes a vertical sync time VS, a vertical front porch FP, and a vertical back porch BP. The vertical sync time VS is the time from the falling edge to the rising edge in the Vsync. The vertical sync time VS represents the start and end of the screen.

Figure 8:
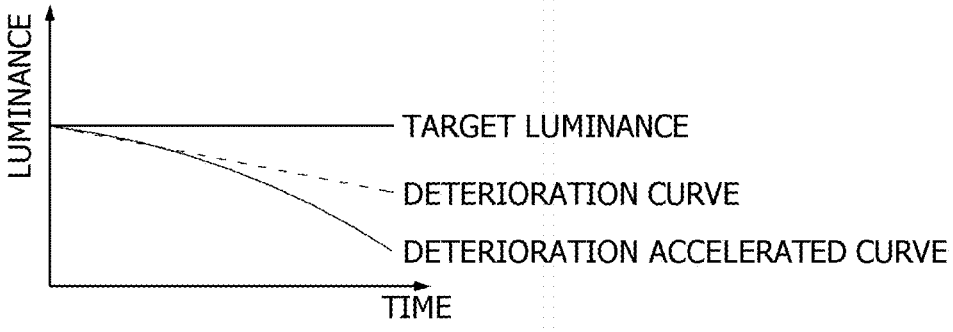
FIG. 8 is a diagram showing deterioration of a sub-pixel and acceleration of deterioration due to deterioration compensation.

FIG. 8 is a diagram showing deterioration of a sub-pixel and acceleration of deterioration due to deterioration compensation.

Referring to FIG. 8, as the driving time of pixels increases, deterioration of the pixels may cause the threshold voltage of the driving element DT to be shifted. When pixel data is modulated with a compensation value to compensate for the deterioration of the pixel, the gate voltage of the driving element DT increases and thus deterioration of the pixels is accelerated, so that the lifetime of the pixels may be shorter.

Figure 9:
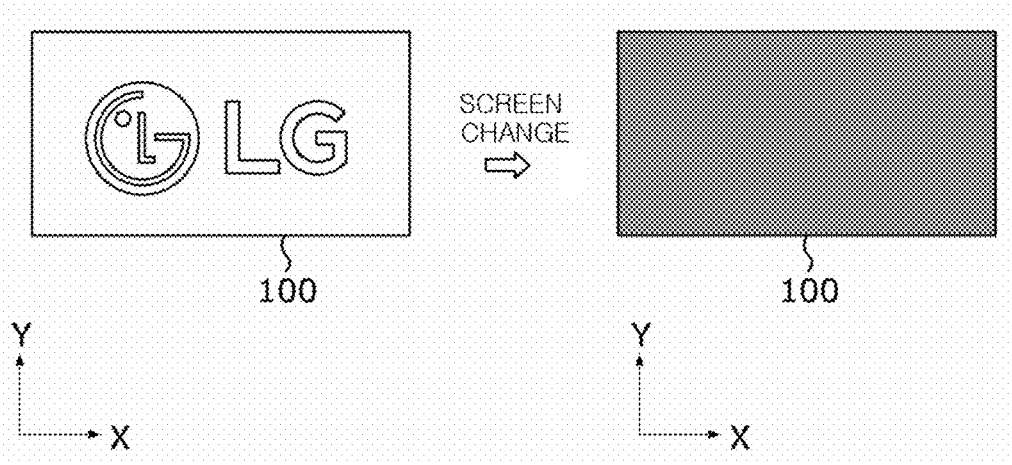
FIG. 9 is a diagram illustrating an example of a screen in which an afterimage is caused.

As shown in FIG. 9, when an image with small movement (stress image) is displayed on the display panel 100, a DC gate bias stress of the driving element DT increases, so that the threshold voltage Vth of the driving element DT may be shifted. After such a stress image is displayed for a long time, if pixel data of the same gray scale (full gray image) is written to all pixels, an afterimage is visible.

Figure 10:
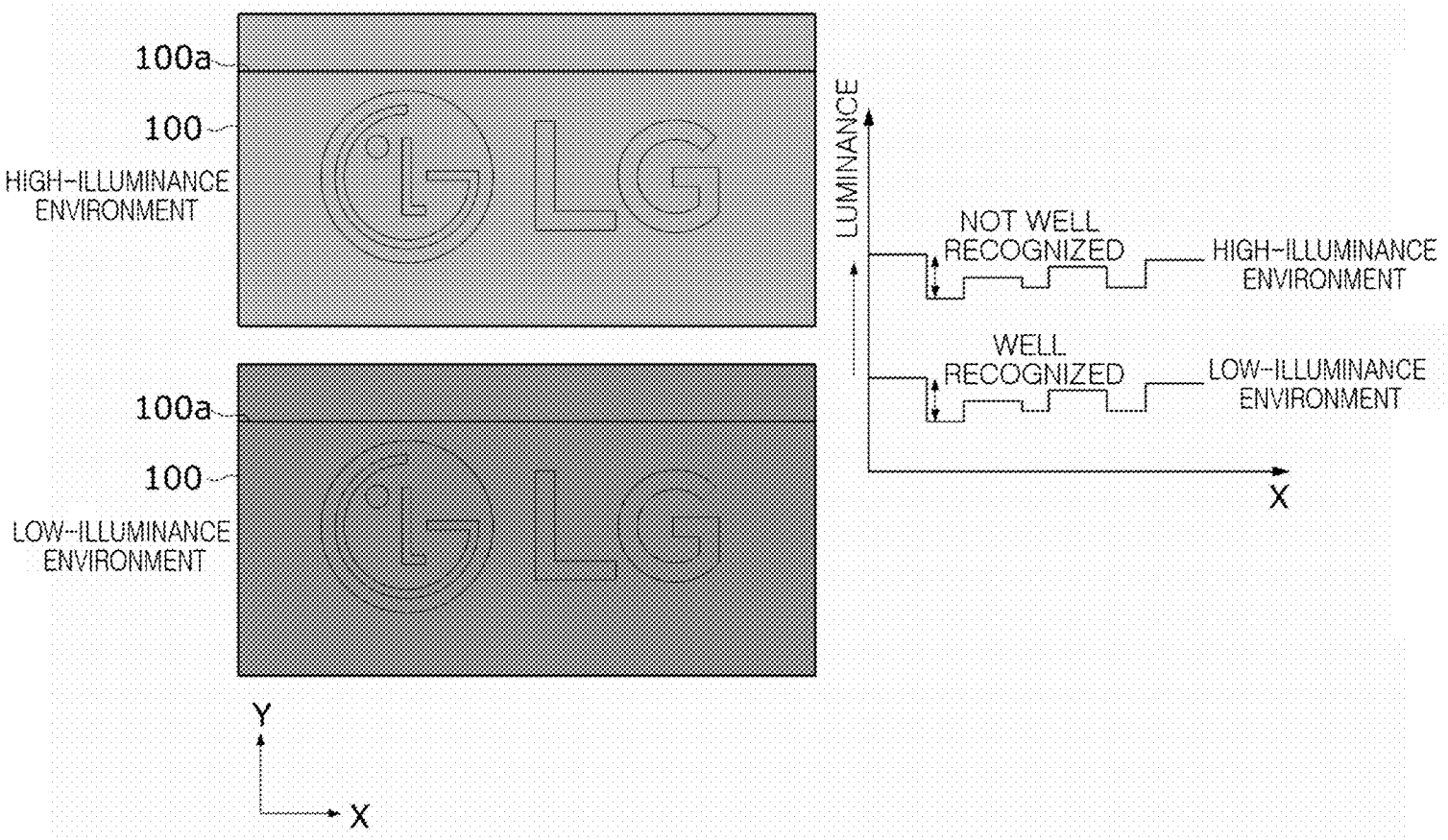
FIG. 10 is a diagram showing a difference in visibility of an afterimage according to illuminance.

The visibility of the afterimage as in the example of FIG. 9 is varied according to the surrounding illuminance of the display panel 100. FIG. 10 is a diagram showing a difference in visibility of an afterimage according to illuminance in a specific pixel line 100*a* of a screen where the afterimage is visible.

Referring to FIG. 10, since there is little external light reflected from the display panel 100 in a low-illuminance environment, an afterimage on the display panel 100 is easily seen. On the other hand, since there is a lot of external light reflected from the display panel 100 in a high-illuminance environment, the reflected luminance due to the light reflected on the display panel 100 is high. For this reason, the afterimage on the display panel 100 is invisible in the high-illuminance environment. In the graph on the right in FIG. 10, X is a pixel position on the screen.

Figure 11:
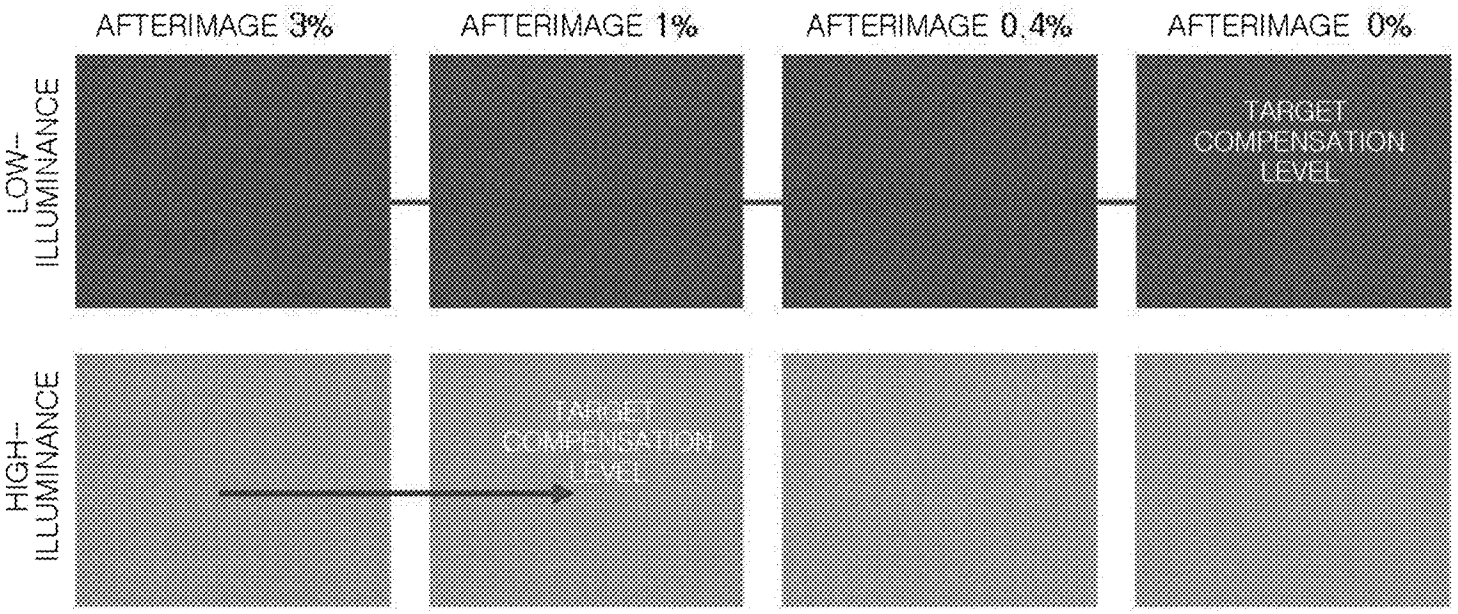
FIG. 11 is a diagram showing a change in a target compensation level according to illuminance.

The compensation block 200 lowers a target compensation level for compensating for an afterimage in consideration of characteristics of low visibility of the afterimage in high illumination, thereby mitigating deterioration acceleration of pixels without an afterimage visually recognized by a user. Accordingly, the lifetime of the pixels may be extended. For example, the compensation block 200 may compensate for deterioration of pixels with a compensation value of a target compensation level (reference value) set to 0% afterimage in order to reduce 3% afterimage to 0% afterimage in a low-illuminance environment, as in the example of FIG. 11. In contrast, the compensation block 200 may compensate for deterioration of pixels with an illuminance-based compensation value of the target compensation level set from 3% afterimage in a high-illuminance environment to 1% afterimage in which a user does not feel afterimage.

Figure 12:
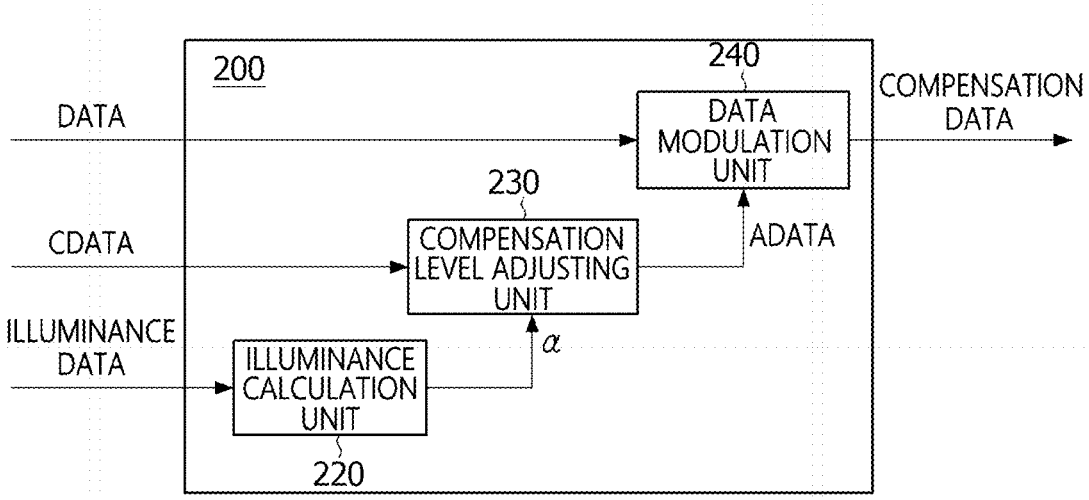
FIG. 12 is a diagram showing in detail a compensation block according to an aspect of the present disclosure.

FIG. 12 is a diagram showing in detail a compensation block 200 according to an aspect of the present disclosure.

Referring to FIG. 12, the compensation block 200 includes an illuminance calculation unit 220, a compensation level adjusting unit 230, and a data modulation unit 240.

The illuminance calculation unit 220 receives illuminance data from the illuminance sensor 300 or the photo sensor PS and determines a compensation adjustment variable α according to the illuminance. The compensation adjustment variable α may be determined as a value having an inversely proportional relationship to the illuminance.

The compensation level adjusting unit 230 receives a compensation value selected according to a deterioration sensing value or a predicted value of a pixel and a compensation adjustment variable α from the illuminance calculation unit 220. The compensation level adjusting unit 230 adjusts the target compensation level by a ratio defined by the compensation adjustment variable α by multiplying the compensation value by the compensation adjustment variable α. If the compensation adjustment variable α is inversely proportional to the illuminance, the higher the illuminance in a high-illuminance environment, the lower the target compensation level. In the low-illuminance environment, the target compensation level is relatively high. The compensation level adjusting unit 230 adjusts a compensation value as much as target compensation levels that change according to illuminance to output an illuminance-based compensation value. In high illumination, the illuminance-based compensation value ADATA is lowered by the target compensation level of high illumination. In the display device of the present disclosure, when the illuminance in the use environment is changed, the target compensation level is changed, so that a modulation width of the pixel data DATA may be reduced.

The data modulation unit 240 receives pixel data DATA of an input image and an illuminance-based compensation value ADATA from the compensation level adjusting unit 230. The data modulation unit 240 adds or multiplies an illuminance-based compensation value ADATA to pixel data to output compensation data DATA'. Accordingly, it is possible to compensate for deterioration of a pixel within a range not recognized by a user.

Figure 13:
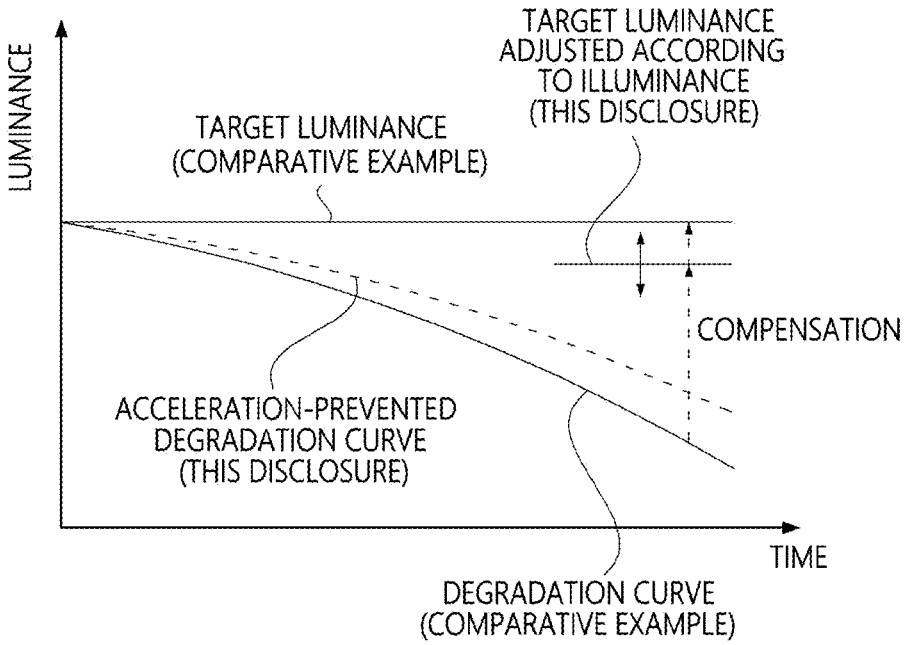
FIG. 13 is a diagram showing an effect of preventing deterioration acceleration obtained by compensation data in which illuminance is reflected.

FIG. 13 is a diagram showing an effect of preventing deterioration acceleration in which illuminance is reflected.

Referring to FIG. 13, a compensation method that does not consider illuminance (comparative example) is fixed to target luminance. In the comparative example, when the luminance decreases according to the deterioration of the pixel, the amount of deterioration compensation increases as time passes in order to obtain the target luminance. In the comparative example, the accumulated amount of stress of the driving element DT is accelerated by the amount of deterioration compensation, so that deterioration of the pixel is accelerated. In contrast, the display device of the present disclosure may mitigate or prevent deterioration acceleration of a pixel by varying the target luminance according to the illuminance and lowering the target luminance in a high-illuminance environment.

Figure 14A:
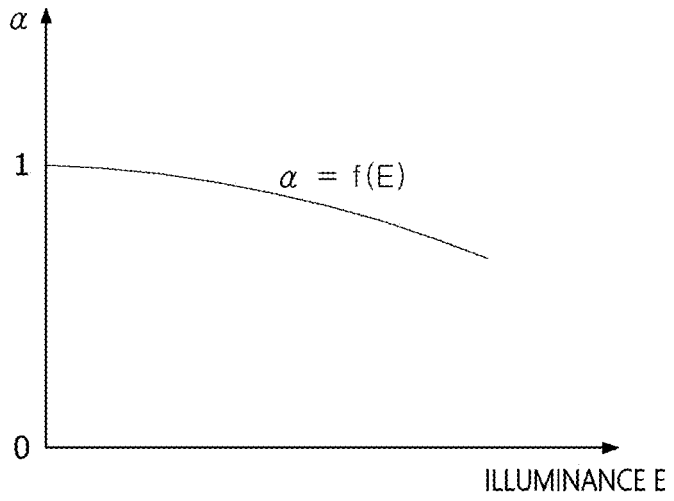
FIGS. 14A and 14B are diagrams showing a compensation adjustment variable according to illuminance.
Figure 14B:
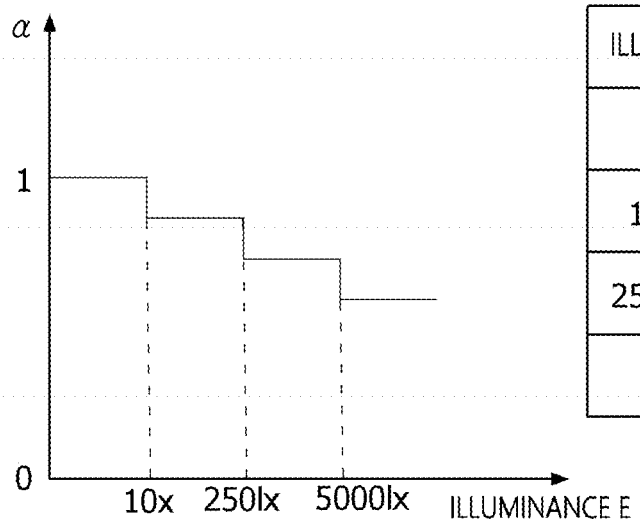

FIGS. 14A and 14B are diagrams showing a compensation adjustment variable α according to illuminance E.

Referring to FIG. 14A, the illuminance calculation unit 220 may calculate a compensation adjustment variable α in real time according to the illuminance E by executing an algorithm using a preset function α=f(E). The function α=f(E) may be determined so that the compensation adjustment variable α has an inversely proportional relationship with the illuminance E. The graph of the function α=f(E) may be experimentally determined according to the characteristics of the display device and the environment of use. For example, when the illuminance E increases, the compensation adjustment variable α may be reduced in the form of an exponential function. The compensation adjustment variable α may have a value between 0 and 1. When α=1, the target compensation level is 100%. In a high-illuminance environment, the target compensation level may be lowered from α=0.8 to α=0.4.

Referring to FIG. 14B, the compensation adjustment variable α may be set to the same value within an illuminance interval having a preset illuminance range, and may be changed stepwise between illuminance intervals. In this case, illuminance E may be divided into n intervals (n is a natural number of two or more). The compensation adjustment variable α may be experimentally determined for each illuminance interval and implemented as a lookup table.

The illuminance calculation unit 220 may select the compensation adjustment variable α using the lookup table in which the compensation adjustment variable α is set for each illuminance interval. When illuminance data is input, the lookup table outputs a compensation adjustment variable α corresponding to an illuminance interval to which the illuminance value indicated by the illuminance data belongs. For example, the illuminance calculation unit 220 may select a target compensation level of 100% by outputting α=1 in low-illuminance of 0 to 10 lx. The illuminance calculation unit 220 outputs α=6 at a high illumination interval between 250 and 5000 lx to lower the target compensation level to 60%, and outputs α=4 at a high illumination of 5000 lx or more to further lower the target compensation level to 40%.

Figure 15:
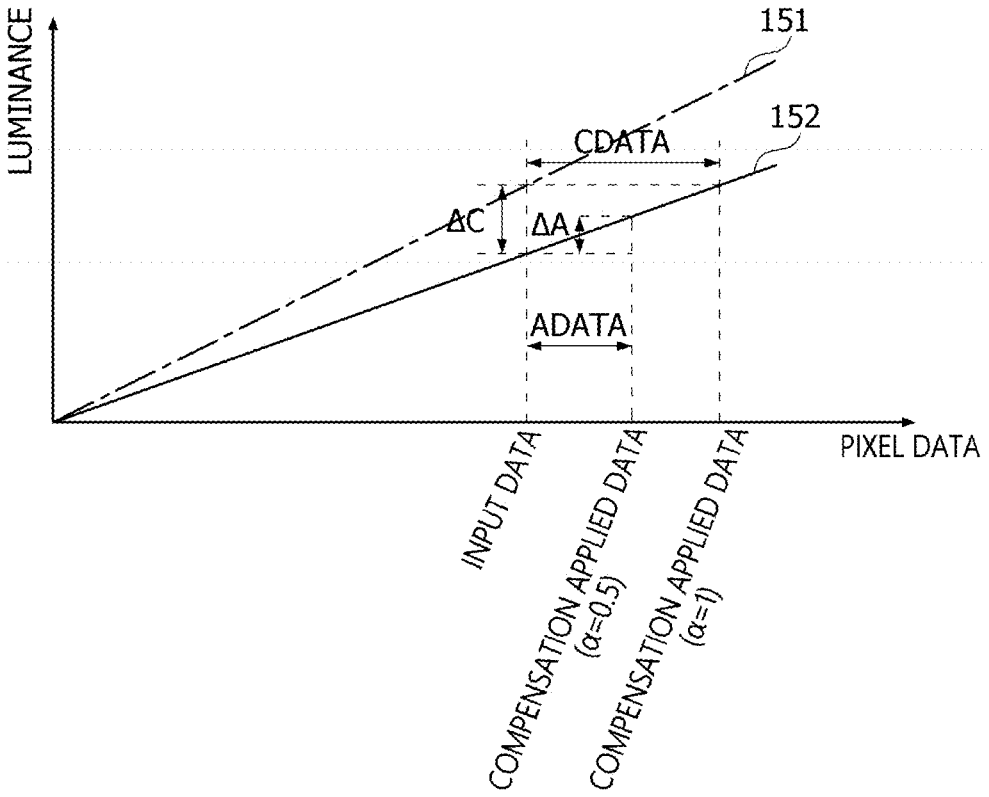
FIG. 15 is a diagram showing compensation data that is varied according to illuminance.

FIG. 15 is a diagram showing compensation data that is varied according to illuminance.

Referring to FIG. 15, the reference numeral "151" denotes a graph of target luminance according to gray scale values of pixel data when there is no deterioration of a pixel. The reference numeral "152" is a graph of luminance that decreases due to deterioration of a pixel.

As may be seen in FIG. 15, when pixel data of the same gray scale is written to a pixel, the target luminance of the pixel may be set lower in a high-illuminance environment than in a low-illuminance environment.

The compensation level adjusting unit 230 receives a compensation value CDATA selected according to a deterioration sensing value or a predicted value of a pixel, and a compensation adjustment variable α from the illuminance calculation unit 220, and adjusts target luminance and compensation value accordingly by a ratio defined by the compensation adjustment variable α selected according to the illuminance to output the illuminance-based compensation value. In FIG. 15, "ΔC" represents the amount of luminance compensation required to reach target luminance in case where there is no deterioration when luminance has been lowered due to deterioration of a pixel. Since the target luminance is lowered in a high-illuminance environment, ΔC is reduced and the compensation value required to obtain the down-adjusted target luminance is reduced. "ADATA" is an illuminance-based compensation value necessary to reach the lowered target luminance in a high-illuminance environment. "ΔA" represents the amount of luminance compensation required to reach the target luminance lowered in a high-illuminance environment when the luminance is lowered due to deterioration of the pixel.

Figure 16:
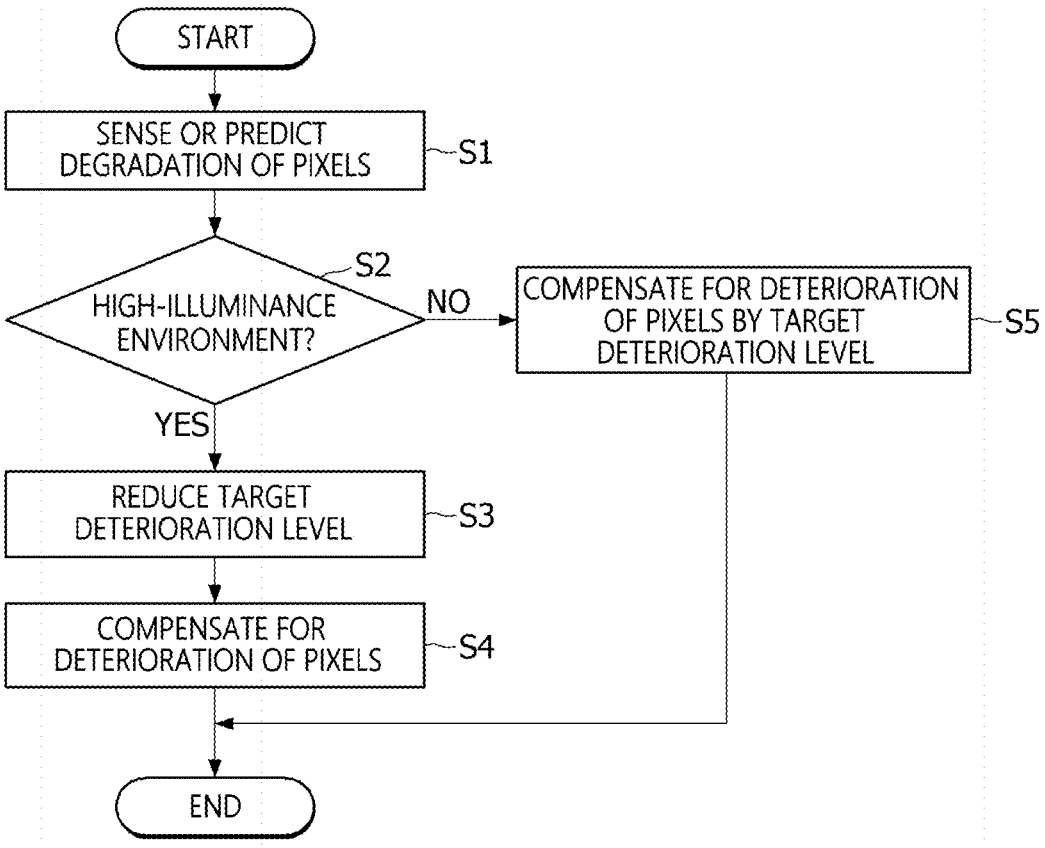
FIG. 16 is a flowchart illustrating a pixel deterioration compensation method according to an aspect of the present disclosure.

FIG. 16 is a flowchart illustrating a pixel deterioration compensation method according to an aspect of the present disclosure.

Referring to FIG. 16, the level of deterioration of each of the sub-pixels may be determined based on a sensing value or a predicted value of deterioration of the sub-pixel (51). The compensation block 200 may adjust the target compensation level of each of the sub-pixels in response to the illuminance data from the illuminance sensor 300 or the photo sensor PS. When the display device is used in a high-illuminance environment, the target compensation level is adjusted to a value lower than the target compensation level (reference value) set based on the low-illuminance environment (S2 and S3).

The compensation block 200 compensates for deterioration of pixels by selecting the target compensation level as a reference value in the low-illuminance environment (S4). The compensation block 200 may compensate for deterioration of pixels without deteriorating image quality by modulating pixel data with compensation data corresponding to a target compensation level varied according to illuminance.

Figure 17:
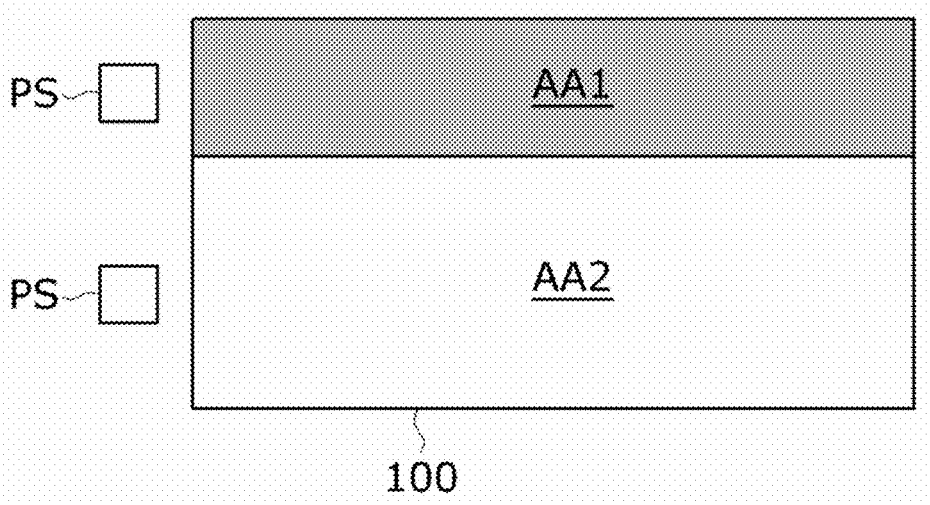
FIG. 17 is a diagram showing an example in which the amount of external light incident on the display panel is partially different.

FIG. 17 is a diagram showing an example in which the amount of external light incident on the display panel is partially different.

Referring to FIG. 17, a plurality of photo sensors PS may be distributed and disposed at different positions on the display panel 100. The compensation block 200 may receive illuminance data from photo sensors PS and control target compensation levels differently between regions having different illuminance on the screen. For example, when the top of the display panel 100 is shaded, the top AA1 of the screen may be applied with a reference value that the target compensation level is set to a low-illuminance reference, while the bottom AA2 of the screen may be applied with a target compensation level lower than the reference value. The changed target compensation level may be applied from the next frame period.

The photo sensors PS may be disposed on the pixel lines, respectively. In this case, the compensation block 200 may independently control the target compensation level for each pixel line by applying a target compensation level that is varied according to illuminance for each pixel line.

Various aspects of the display device of the present disclosure are described below.

First Aspect: the display device includes a display panel 100 in which a plurality of scan lines are intersected with a plurality of data lines and a plurality of pixels are arranged; a deterioration determination unit 111 and 210 configured to determine deterioration of the pixels; a sensing unit 300 and PS configured to sense the illuminance of a surrounding environment of the display panel; and a compensation block configured to receive a deterioration sensing value or a deterioration predicted value from the deterioration determination unit and receive illuminance data from the sensing unit to compensate for the deterioration of the pixels with a target compensation level varied according to the illuminance.

Second Aspect: the target luminance of the pixel is set to be lower in a high-illuminance environment than in a low-illuminance environment when pixel data of the same gray scale is written to the pixel.

Third Aspect: the target compensation level of the pixel for reaching the target luminance of the high-illuminance environment is lower than the target compensation level of the pixel for reaching the target luminance of the low-illuminance environment.

Fourth Aspect: the compensation block modulates pixel data to be written to the pixels with a compensation value lower than a compensation value set as a low-illuminance reference by lowering a target compensation level of the pixel in a high-illuminance environment.

Fifth Aspect: the display device further includes a data driving unit 110 configured to convert the pixel data to a data voltage to supply the pixel data to the data lines.

Sixth Aspect: the sensing unit includes an illuminance sensor disposed outside the display panel.

Seventh Aspect: the sensing unit includes a plurality of photo sensors embedded on the display panel.

Eighth Aspect: the sensing unit includes an illuminance sensor connected to an electronic control unit (ECU) of vehicles.

Ninth Aspect: the compensation block receives lighting data of an indoor light from the electronic control unit (ECU).

Tenth Aspect: the compensation block includes an illuminance calculation unit 220 configured to receive illuminance data from the sensing unit to determine a compensation adjustment variable varied according to the illuminance; a compensation level adjusting unit 230 configured to receive a compensation value according to a deterioration level of the pixel and the compensation adjustment variable $\alpha$ from the illuminance calculation unit and adjusting the compensation value by a ratio defined by the compensation adjustment variable $\alpha$ to output an illuminance-based compensation value; and a data modulation unit 240 configured to receive pixel data of an input image and an illuminance-based compensation value from the compensation level adjusting unit and using the illuminance-based compensation value to modulate the pixel data.

Eleventh Aspect: the compensation adjustment variable is inversely proportional to the illuminance.

Twelfth Aspect: the illuminance calculation unit calculates the compensation adjustment variable according to the illuminance indicated by the illuminance data using a preset function.

Thirteenth Aspect: the illuminance of the surrounding environment of the display panel may be set as a plurality of illuminance intervals. The illuminance calculation unit includes a lookup table in which the compensation adjustment variable is set to the same value within the illuminance interval and set to a value that changes stepwise between illuminance intervals. The illuminance calculation unit selects the compensation adjustment variable by inputting the illuminance data into the lookup table.

Various aspects of the method for compensating pixel deterioration of the present disclosure are described below.

First Aspect: the method includes determining deterioration of the pixels; sensing the illuminance of a surrounding environment of the display panel; and compensating for the deterioration of the pixels with a target compensation level varied according to the illuminance.

Second Aspect: the method further includes controlling the target luminance of the pixel to be lower in a high-illuminance environment than in a low-illuminance environment when pixel data of the same gray scale is written to the pixel.

Third Aspect: the method further includes controlling the target compensation level of the pixel for reaching the target luminance of the high-illuminance environment to be lower than the target compensation level of the pixel for reaching the target luminance of the low-illuminance environment.

While the aspects of the present disclosure have been described in detail above with reference to the accompanying drawings, the present disclosure is not limited to the aspects, and various changes and modifications may be made without departing from the technical spirit of the present disclosure. Accordingly, the aspects disclosed herein are to be considered descriptive and not restrictive of the technical spirit of the present disclosure, and the scope of the technical spirit of the present disclosure is not limited by the aspects.

Therefore, it should be understood that the above aspects are illustrative rather than restrictive in all respects. The scope of the disclosure should be construed by the appended claims, and all technical spirits within the scopes of their equivalents should be construed as being included in the scope of the disclosure.

What is claimed is:

1. A display device comprising:

a display panel in which a plurality of scan lines and a plurality of data lines intersecting with one another and a plurality of pixels are arranged;

a deterioration determination unit configured to determine deterioration of the plurality of pixels;

a sensing unit configured to sense illuminance of surrounding environment of the display panel; and a compensation block configured to receive a deterioration sensing value or a deterioration predicted value from the deterioration determination unit and receive illuminance data from the sensing unit to compensate for the deterioration of the pixels with a target compensation level varied according to the illuminance, wherein a target luminance of the plurality of pixels is set to be lower in a high-illuminance environment than in a low-illuminance environment when pixel data of the same gray scale is written to the plurality of pixels.

2. The display device of claim 1, wherein the target compensation level of the plurality of pixels for reaching the target luminance of the high-illuminance environment is lower than the target compensation level of the pixel for reaching the target luminance of the low-illuminance environment.

3. The display device of claim 1, wherein the compensation block modulates pixel data to be written to the pixels with a compensation value lower than a compensation value set as a low-illuminance reference by lowering a target compensation level of the plurality of pixels in the high-illuminance environment.

4. The display device of claim 3, further comprising a data driving unit configured to convert the pixel data to a data voltage to supply the pixel data to the plurality of data lines.

5. The display device of claim 1, wherein the sensing unit includes an illuminance sensor disposed outside the display panel.

6. The display device of claim 1, wherein the sensing unit includes a plurality of photo sensors embedded in the display panel.

7. The display device of claim 1, wherein the sensing unit includes an illuminance sensor connected to an electronic control unit (ECU) of vehicles.

8. The display device of claim 7, wherein the compensation block receives lighting data of indoor light from the electronic control unit (ECU) of vehicles.

9. The display device of claim 1, wherein the compensation block includes:

an illuminance calculation unit configured to receive illuminance data from the sensing unit to determine a compensation adjustment variable varied according to the illuminance;

a compensation level adjusting unit configured to receive a compensation value according to a deterioration level of each of the plurality of pixels and the compensation adjustment variable from the illuminance calculation unit and adjusting the compensation value by a ratio defined by the compensation adjustment variable to output an illuminance-based compensation value; and a data modulation unit configured to receive pixel data of an input image and an illuminance-based compensation value from the compensation level adjusting unit and using the illuminance-based compensation value to modulate the pixel data.

10. The display device of claim 9, wherein the compensation adjustment variable is inversely proportional to the illuminance.

11. The display device of claim 9, wherein the illuminance calculation unit calculates the compensation adjustment variable according to the illuminance indicated by the illuminance data using a preset function.

12. The display device of claim 9, wherein the illuminance of the surrounding environment of the display panel is set as a plurality of illuminance intervals, wherein the illuminance calculation unit includes a lookup table in which the compensation adjustment variable is set to the same value within the illuminance interval and set to a value that changes stepwise between illuminance intervals, and wherein the illuminance calculation unit selects the compensation adjustment variable by inputting the illuminance data into the lookup table.

13. A method for compensating pixel deterioration of a display device including a display panel in which a plurality of scan lines and a plurality of data lines intersect with one another and a plurality of pixels are arranged, the method comprising:

determining deterioration of the plurality of pixels;

sensing the illuminance of surrounding environment of the display panel;

compensating for the deterioration of the plurality of pixels with a target compensation level varied according to the illuminance; and controlling a target luminance of the pixel to be lower in a high-illuminance environment than in a low-illuminance environment when pixel data of the same gray scale is written to the plurality of pixels.

14. The method of claim 13, further comprising controlling the target compensation level of the pixel for reaching the target luminance of the high-illuminance environment to be lower than the target compensation level of the plurality of pixels for reaching the target luminance of the low-illuminance environment.

15. The method of claim 14, further comprising modulating pixel data to be written to the pixels with a compensation value lower than a compensation value set as a low-illuminance reference by lowering a target compensation level of the plurality of pixels in the high-illuminance environment.

16. The method of claim 15, further comprising converting the pixel data to a data voltage to supply the pixel data to the plurality of data lines.

* * * * *